US007507303B2

(12) United States Patent
Li

(10) Patent No.: US 7,507,303 B2
(45) Date of Patent: Mar. 24, 2009

(54) CARBONITRIDED LOW MANGANESE CARBON STEEL ALLOY DRIVELINE COMPONENT

(75) Inventor: Huaxin Li, Rochester Hills, MI (US)

(73) Assignee: ArvinMeritor Technology, LLC, Troy, MI (US)

( * ) Notice: Subject to any disclaimer, the term of this patent is extended or adjusted under 35 U.S.C. 154(b) by 445 days.

(21) Appl. No.: 10/936,264

(22) Filed: Sep. 8, 2004

(65) Prior Publication Data

US 2006/0048863 A1 Mar. 9, 2006

(51) Int. Cl.
*C22C 38/06* (2006.01)
*C22C 38/04* (2006.01)

(52) U.S. Cl. ..... 148/318; 148/319

(58) Field of Classification Search ..... 148/320, 148/218–219, 318, 319, 586, 587
See application file for complete search history.

(56) References Cited

U.S. PATENT DOCUMENTS

| | | | | |
|---|---|---|---|---|
| 4,470,854 | A * | 9/1984 | Nakamura | 148/219 |
| 5,595,610 | A | 1/1997 | Maeda et al. | |
| 6,083,455 | A * | 7/2000 | Kurita et al. | 420/126 |
| 2003/0104872 | A1 | 6/2003 | Lobozov et al. | |

FOREIGN PATENT DOCUMENTS

| | | | |
|---|---|---|---|
| JP | 360262941 | * | 12/1985 |
| JP | 402050944 | * | 2/1990 |
| JP | 406172867 | * | 6/1994 |
| JP | 409067644 | * | 3/1997 |
| JP | 2004076823 | * | 3/2007 |
| RU | 2164536 | | 4/2000 |
| RU | 2158320 | | 10/2000 |
| RU | 2176754 | | 10/2001 |
| RU | 2221058 | | 3/2002 |
| RU | 2213280 | | 8/2002 |

OTHER PUBLICATIONS

Computer-generated English translation of Japnaese patent 09-67644, Hatano et al. Mar. 11, 1997.*
Human-English translation of Japanese patent 409067644 A , Atsuomi Hatano et al., Mar. 11, 1997.*
U.S. Appl. No. 10/936,239, filed Sep. 8, 2004.
ASM Handbook (vol. 4, Heat Treating, Fig. 1, p. 377/Carbonitriding). Published Dec. 1, 1991.

* cited by examiner

*Primary Examiner*—Deborah Yee
(74) *Attorney, Agent, or Firm*—Carlson, Gaskey & Olds

(57) ABSTRACT

An alloy composition forms a steel having low manganese content, low silicon content, and medium carbon content. The alloy composition comprises in combination, by weight, about 0.3 to 0.5% carbon (C) and 0.15 to 0.40% manganese (Mn), with the balance being essentially iron (Fe). Further, the alloy composition has no more than about 0.04% aluminum (Al), no more than about 0.035% phosphorous (P), no more than about 0.025% sulfur (S), no more than about 0.15% chromium (Cr), no more than about 0.18% silicon (Si), and no more than about 0.08% molybdenum (Mo). The use of an alloy composition with lower silicon and manganese contents eliminates the need for prolonged carbuization. Instead, shorter carbonitriding cycles can be used, which results in improved residual stress, bending fatigue, and surface characteristics for driveline components.

11 Claims, 1 Drawing Sheet

CARBONITRIDED LOW MANGANESE CARBON STEEL ALLOY DRIVELINE COMPONENT

TECHNICAL FIELD

The subject invention provides a low manganese content, low silicon content, and medium carbon content steel that is more cost effective and improves residual stress, bending fatigue, and surface characteristics for driveline components.

BACKGROUND OF THE INVENTION

Driveline components, such as gears, for example, are traditionally formed from a low carbon content steel. One example of a gear material is SAE 8822H, which is a carburizing grade alloy steel. SAE 8822H has the following chemical composition, in combination, by weight: 0.19-0.25% carbon (C), 0.70-1.05% manganese (Mn), 0.15-0.35% silicon (Si), 0.35-0.75% nickel (Ni), 0.35-0.65% chromium (Cr), 0.30-0.40% molybdenum (Mo), no more than 0.035% phosphorous (P), and no more than 0.040% sulfur (S), with the balance being essentially iron (Fe).

Some gear steels, such as SAE 8822H, are specially designed carburization grade steels that are alloyed-low carbon content steels (0.10-0.27% carbon), which traditionally are expensive. Carburizing is a process in which carbon is added to a surface of an iron-base alloy by absorption through heating the alloy at a temperature below a melting point of the alloy, while providing contact with carbonaceous solids, liquids, or gases. In order to achieve desired final hardness and surface characteristics, the SAE 8822H material is carburized, quenched, and tempered.

Carburization is a prolonged process and can take as long as ten to twenty-four hours, depending on case depth requirements. Prolonged processing and expensive steel grades increase manufacturing costs for gears and other driveline components. Also, the prolonged carburization process causes non-martensite transformation products (NMTP) and intergranular oxides (IGO) to form at a surface of the component. NMTP and IGO adversely affect bending fatigue strength and wear resistance. Thus, the occurrence of both NMTP and IGO can significantly reduce service life of the component.

High carbon content steels (0.60-0.80% carbon) can also be used to form driveline components. Some examples of high carbon content steels are disclosed in RU2158320. These examples include 62ПП1, 62ПП2, 62ПП3, 62ПП4, 62ПН1, and 80ПП1.

62ПП1 has the following chemical composition, in combination, by weight: 0.60-0.67% carbon (C), 0.05-0.15% manganese (Mn), no more than 0.05% silicon (Si), no more than 0.10% chromium (Cr), no more than 0.10% nickel (Ni), no more than 0.10% copper (Cu), 0.03-0.10% aluminum (Al), 0.06-0.12% titanium (Ti), no more than 0.40% vanadium (V), no more than 0.040% sulfur (S), and no more than 0.035% phosphorous (P), with the balance being essentially iron (Fe).

62ПП2 has the following chemical composition, in combination, by weight: 0.60-0.67% carbon (C), no more than 0.10% manganese (Mn), 0.10-0.20% silicon (Si), no more than 0.10% chromium (Cr), no more than 0.10% nickel (Ni), no more than 0.10% copper (Cu), 0.03-0.10% aluminum (Al), 0.06-0.12% titanium (Ti), no more than 0.40% vanadium (V), no more than 0.040% sulfur (S), and no more than 0.035% phosphorous (P), with the balance being essentially iron (Fe).

62ПП3 has the following chemical composition, in combination, by weight: 0.60-0.67% carbon (C), 0.05-0.15% manganese (Mn), 0.05-0.15% silicon (Si), no more than 0.10% chromium (Cr), no more than 0.10% nickel (Ni), no more than 0.10% copper (Cu), 0.03-0.10% aluminum (Al), 0.06-0.12% titanium (Ti), no more than 0.40% vanadium (V), no more than 0.040% sulfur (S), and no more than 0.035% phosphorous (P), with the balance being essentially iron (Fe).

62ПП4 has the following chemical composition, in combination, by weight: 0.60-0.67% carbon (C), 0.10-0.20% manganese (Mn), 0.10-0.20% silicon (Si), no more than 0.10% chromium (Cr), no more than 0.10% nickel (Ni), no more than 0.10% copper (Cu), 0.03-0.10% aluminum (Al), 0.06-0.12% titanium (Ti), no more than 0.40% vanadium (V), no more than 0.040% sulfur (S), and no more than 0.035% phosphorous (P), with the balance being essentially iron (Fe).

62ПН1 has the following chemical composition, in combination, by weight: 0.60-0.67% carbon (C), no more than 0.06% manganese (Mn), no more than 0.06% silicon (Si), no more than 0.06% chromium (Cr), no more than 0.06% nickel (Ni), no more than 0.06% copper (Cu), 0.03-0.10% aluminum (Al), 0.06-0.12% titanium (Ti), 0.20-0.30% vanadium (V), no more than 0.040% sulfur (S), and no more than 0.035% phosphorous (P), with the balance being essentially iron (Fe).

80ПП1 has the following chemical composition, in combination, by weight: 0.78-0.85% carbon (C), no more than 0.10% manganese (Mn), no more than 0.05% silicon (Si), no more than 0.10% chromium (Cr), no more than 0.10% nickel (Ni), no more than 0.10% copper (Cu), 0.03-0.10% aluminum (Al), 0.06-0.12% titanium (Ti), no more than 0.40% vanadium (V), no more than 0.040% sulfur (S), and no more than 0.035% phosphorous (P), with the balance being essentially iron (Fe).

An example of a process used to achieve desired material characteristics for high carbon content steels (0.60-0.80% carbon) such as 62ПП1, 62ПП2, 62ПП3, 62ПП4, 62ПН1, and 80ПП1, is thru-surface hardening (TSH). This process heats the steel in a controlled furnace atmosphere for about 40 minutes to one hour, and then subsequently quenches the steel in a water based solution. This process provides an irregular case profile and has a root case depth of approximately 0.045 to 0.060 inches for gears. The gear pitch line core hardness is greater than 55 Rockwell C and surface hardness is 58-63 Rockwell C. Microstructure 0.010 inches beneath the surface is martensite only for 0.60% carbon steel, and is martensite and retained austenite for 0.80% carbon steel.

Thus, high carbon content steels such as 62ПП1, 62ПП2, 62ПП3, 62ПП4, 62ПН1, and 80ПП1, do not require a lengthy carburization process to achieve desired material characteristics and instead can use a much shorter TSH process. However, TSH also has some disadvantages. The high carbon content makes machining very difficult. The core hardness is greater than 55 Rockwell C, which makes the gear teeth more brittle and more easily broken by shock loading. Further, when the microstructure consists mostly of martensite at the surface, wear resistance is adversely affected.

It is desirable to have an improved material that can be used to make driveline components, such as gears and shafts, that does not require prolonged carburization or thru-surface hardening, is less expensive, and has improved surface characteristics, as well as overcoming the other above-mentioned deficiencies in the prior art.

SUMMARY OF THE INVENTION

An alloy composition forms a steel having a low manganese content, low silicon content, and medium carbon content. The alloy composition comprises in combination, by weight, about 0.3 to 0.5% carbon (C) and 0.15 to 0.40% manganese (Mn) with the balance being essentially iron (Fe).

In one example, the alloy composition has no more than about 0.04% aluminum (Al), no more than about 0.035% phosphorous (P), no more than about 0.025% sulfur (S), no more than about 0.15% chromium (Cr), no more than about 0.18% silicon (Si), and/or no more than about 0.08% molybdenum (Mo).

The alloy composition can be used to form a variety of components. In one example, the alloy composition is used to form driveline component such as a gear or shaft. A preferred example for a gear component is an alloy composition comprising in combination, by weight, about 0.38% carbon (C), 0.23% manganese (Mn), 0.012% phosphorous (P), 0.010% sulfur (S), 0.04% silicon (Si), 0.07% chromium (Cr), 0.02% molybdenum (Mo), 0.20% copper (Cu), and 0.025% aluminum (Al), the balance being essentially iron (Fe). A preferred example for a shaft component is an alloy composition comprising in combination, by weight, about 0.46% carbon (C), 0.28% manganese (Mn), 0.020% phosphorous (P), 0.010% sulfur (S), 0.10% silicon (Si), 0.08% chromium (Cr), 0.02% molybdenum (Mo), 0.20% copper (Cu), and 0.025% aluminum (Al), the balance being essentially iron (Fe).

The low manganese, low silicon, and medium carbon content alloy composition improves mechanical properties for these driveline components while additionally reducing material and manufacturing costs. The unique alloy composition also eliminates the need for prolonged carburization cycles. The alloy composition utilizes short carbonitriding cycles, which also significantly reduces adverse surface characteristics. For example, intergranular oxidation and non-martensite transformation products are virtually eliminated from surfaces of the driveline component when the carbonitriding process is used.

These and other features of the present invention can be best understood from the following specification and drawings, the following of which is a brief description.

DETAILED DESCRIPTION OF THE PREFERRED EMBODIMENT

Figure 1:
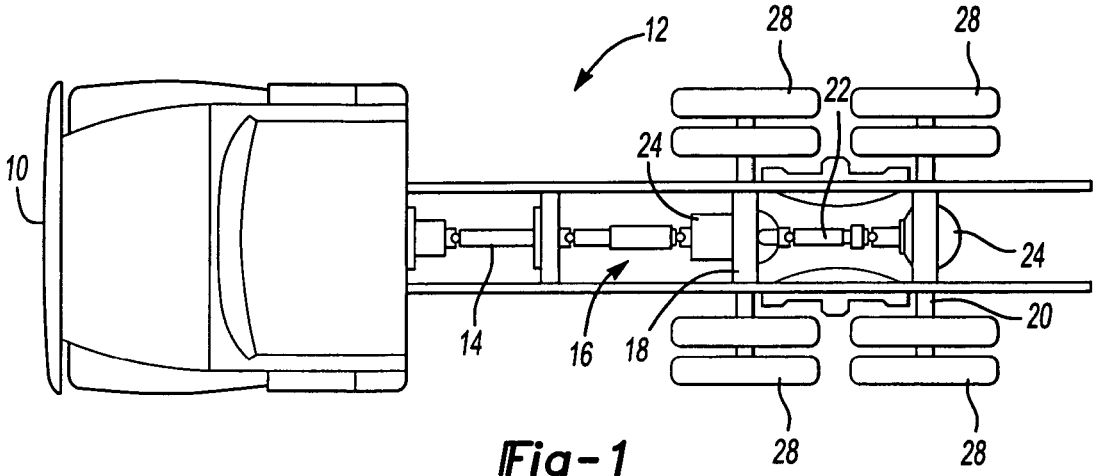
FIG. 1 is a schematic overhead view of a vehicle driveline including a driveline component formed from a material and process incorporating the subject invention.

A vehicle 10 includes a driveline assembly 12. The driveline assembly 12 includes a driveshaft 14 that is coupled to a drive axle assembly 16. The drive axle assembly 16 can be a single drive axle or a tandem drive axle. In the example shown in FIG. 1, the drive axle assembly 16 is a tandem drive axle assembly including a forward-rear axle 18 and a rear-rear axle 20 coupled together with an interconnecting driveshaft 22.

Figure 2:
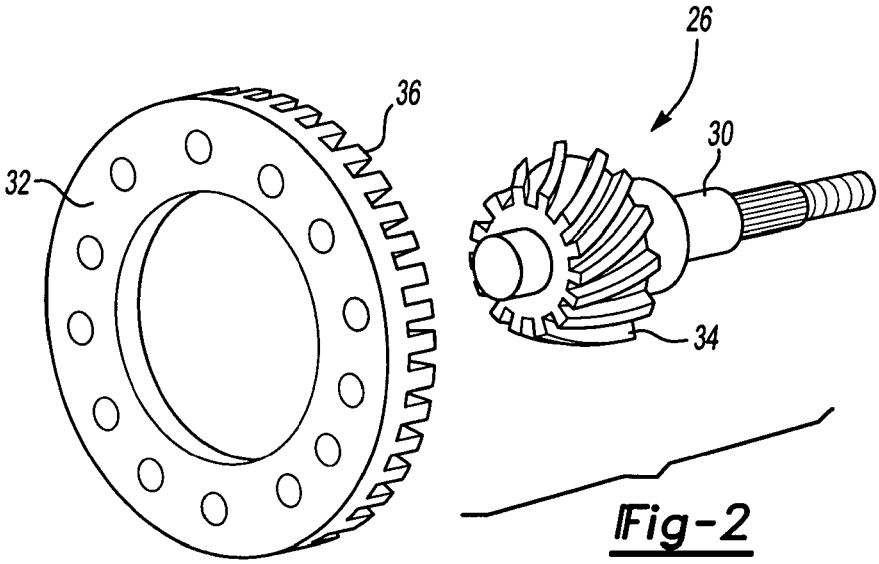
FIG. 2 is an exploded view of one example of a driveline component that can be formed from the material and process incorporating the subject invention.

The forward-rear 18 and rear-rear 20 axles each include a carrier assembly 24 that includes an input gear set 26 (see FIG. 2) and a differential assembly (not shown) that cooperate to drive laterally spaced wheels 28. The subject invention utilizes a unique material and process to form driveline components, such as the input gear set 26, for example. The input gear set 26 typically includes an input pinion 30 that drives a ring gear 32. The input pinion 30 includes a plurality of pinion teeth 34 that meshingly engage a plurality of ring gear teeth 36 formed on the ring gear 32. The input gear set 26 provides driving input into the differential assembly as known.

It should be understood that while the subject invention is described in relation to an input gear set 26, the unique material and process could be used to form other driveline components. Further, the unique material and process could also benefit non-driveline components.

The subject invention is for an alloy composition providing a low manganese (Mn) content, low silicon (Si) content, and medium carbon (C) content steel. The alloy composition comprises in combination, by weight, about: 0.30 to 0.50% carbon (C), 0.15 to 0.40% manganese (Mn), no more than about 0.04% aluminum (Al), no more than about 0.035% phosphorous (P), no more than about 0.025% sulfur (S), no more than about 0.15% chromium (Cr), no more than about 0.18% silicon (Si), and no more than about 0.08% molybdenum (Mo), with the balance being essentially iron (Fe).

As discussed above, this alloy composition can be used as a driveline component material. In one example, the alloy composition is used to form the input pinion 30 and ring gear 32. In this gear example, the alloy composition would preferably have approximately 0.32-0.42% carbon (C) and 0.15 to 0.40% manganese (Mn), the balance being essentially iron (Fe).

In one working example for a gear, the alloy composition comprises in combination, by weight, about: 0.38% carbon (C), 0.23% manganese (Mn), 0.012% phosphorous (P), 0.010% sulfur (S), 0.04% silicon (Si), 0.07% chromium (Cr), 0.02% molybdenum (Mo), 0.20% copper (Cu), and 0.025% aluminum (Al), the balance being essentially iron (Fe). In this example, the iron (Fe) would be about 99.103%

In another example, the alloy composition is used to form a shaft, such as driveshaft 14. Other shafts such as input shafts to the forward-rear axle 18, the interconnecting driveshaft 22, a thru-shaft for an inter-axle differential assembly (not shown), or axle shafts (not shown) that are driven by the differential assemblies, could also be formed from the alloy compositions. In this shaft example, the alloy composition would have approximately 0.42-0.50% carbon (C) and 0.15 to 0.40% manganese (Mn), the balance being essentially iron (Fe).

In one working example for a shaft, the alloy composition comprises in combination, by weight, about 0.46% carbon (C), 0.28% manganese (Mn), 0.020% phosphorous (P), 0.010% sulfur (S), 0.10% silicon (Si), 0.08% chromium (Cr), 0.02% molybdenum (Mo), 0.20% copper (Cu), and 0.025% aluminum (Al), the balance being essentially iron (Fe). In this example, the iron (Fe) would be about 98.805%.

It should be understood that the working examples for the gear and the shaft are just one example of the subject alloy composition for these components and that other combinations of ranges for the above-described elements could also be used depending upon desired final material characteristics.

Further, the subject low manganese, low silicon, medium carbon content steel is an aluminum killed steel. This means that aluminum has been used as a deoxidizing agent. The term "killed" indicates that steel has been sufficiently deoxidized to quiet molten metal when casted.

The unique material of a low manganese (Mn) content, low silicon (Si) content, and medium carbon (C) content steel (LMn-LSi-MCS) is subjected to a unique heat treating process that includes carbonitriding. Carbonitriding is a case-hardening process in which steel components are heated in an atmosphere that includes both carbon (C) and nitrogen (N).

Case-hardening is a term that refers to a process that changes the chemical composition of a surface layer of a steel component by absorption of carbon or nitrogen, or a mixture of both carbon and nitrogen. The process uses diffusion to create a concentration gradient so that an outer portion (case) of the steel component is made substantially harder than an inner portion (core).

The subject heat treating process includes carbonitriding the LMn-LSi-MCS for three (3) to six (6) hours at about 1600° F. to 1750° F. in an appropriate furnace atmosphere having about 0.75-1.1% carbon (C) potential and 4.0-8.0% ammonia ($NH_3$). Ammonia is used to provide the nitrogen (N) required by the carbonitriding process. The heat treat can be accomplished in many different ways.

In one example, the carbonitriding is done for 3-5 hours at approximately 1600° F. The target atmosphere for this example is approximately 5% ammonia and 0.8% carbon potential.

In another example, carburization is done for about two to four hours at a temperature of about 1750° F. in an atmosphere having a target value of approximately 1% carbon potential. The temperature is then decreased to 1600° F. and carbonitriding is done for about one to three hours. Ammonia is introduced into the furnace atmosphere and the target atmosphere has about 5% ammonia and 0.8% carbon potential.

In either example, once the carbonitriding process is complete, the LMn-LSi-MCS is quenched in a water based solution at room temperature. The quench is preferably a controlled intense quench.

Figure 3:
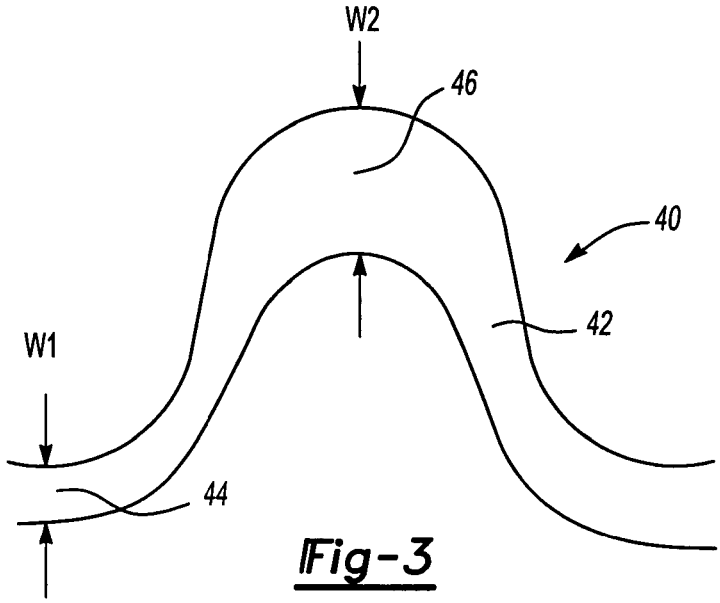
FIG. 3 is a schematic view showing an irregular case profile for a gear tooth formed from the material and process incorporating the subject invention.

The subject process provides an irregular case profile, which is different than the regular case profile produced by a traditional carburizing process. As shown in FIG. 3, a gear tooth 40 has an irregular case profile with a case 42 that has a first width W1 at a tooth root 44 and a second width W2 at a tooth tip 46. As shown, W2 is greater than W1. In this configuration, case depths need to be defined at both a gear pitch line and at the tooth root 44 depending on application and material composition. Also core hardness for the pitch line and case depth for the tooth root 44 will also need to be defined depending on application and material composition.

When the subject process is used on a gear component, for example, the process produces a root case depth of approximately 0.045-0.080 inches. This provides an effective case depth of about 0.045 to 0.080 where hardness is no less than 50 Rockwell C. A target core hardness is no more than 50 Rockwell C with a surface hardness in the range of 58-63 Rockwell C.

One of the benefits of this process is that there is very little or no intergranular oxidation (IGO). IGO is detrimental to bending fatigue and wear resistance. IGO is virtually eliminated in this process by limiting the potential for IGO by minimizing the amount of the manganese, silicon, and chromium elements and by reducing the length of heating time. Elimination of IGO provides higher compressive residual stress and virtually eliminates the problem of micro-cracks.

The subject process also significantly reduces the occurrence of surface high temperature transformation product (HTTP). By reducing the length of heating time and adding nitrogen, HTTP is virtually eliminated. HTTP is also detrimental to bending fatigue and wear resistance due to the formation of a softer, non-martensitic material at the surface.

The resulting microstructure at 0.010 inches beneath the surface is martensite and retained austenite. The compressive residual stress is greater than 140 ksi, which is better than can be achieved by carburizing and shot peening, and is the same or better than can be achieved by thru-surface hardening.

While the subject process is used for the LMn-LSi-MCS described above, i.e. the alloy composition having about 0.30-0.50% carbon, it should be understood that the process could be beneficial to other material compositions. For example, the process could be used for alloy compositions having a range of 0.30-0.75% carbon.

This low manganese, low silicon, medium carbon content steel improves mechanical properties and reduces material and manufacturing costs for components. The case depth is controlled by steel chemistries and quench technologies so that there is no need to have prolonged carburization cycles. Further, the lower silicon and manganese contents, in combination with the short carbonitriding cycles, significantly reduces IGO and HTTP. Also, due to the low hardenability of the steel, there are higher surface compressive residual stresses.

Another benefit with the subject process is that all component sizes, i.e. different gear and shaft sizes, can be processed with the same parameters. This is an improvement over the traditional carburizing process, which utilized different lengths of times for different components. The carbonitriding time cycles are also significantly shorter than the carburizing time cycles. This reduces manufacturing costs and processing complexity. Further, the LMn-LSi-MCS is less expensive than carburization grade steel. This reduces material costs.

The subject material and process provides a carbonitrided low manganese, low silicon, medium carbon content steel that is less expensive, easier and cheaper to process, and provides improved mechanical properties. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An alloy composition comprising in combination, by weight, about:

0.30 to 0.50% carbon (C);

0.025% to 0.04% aluminum (Al);

0.23% to 0.28% manganese (Mn);

a non-zero amount up to 0.04% silicon (Si); and a balance of iron (Fe), wherein the alloy composition is in a shape of a driveline component having a carbonitrided case with a surface hardness within about 58 to 63 Rockwell C.

2. The alloy composition of claim 1 wherein a core of the alloy composition located adjacent the carbonitrided case comprises a core hardness of no more than 50 Rockwell C.

3. The alloy composition of claim 1 wherein the driveline component is a gear.

4. The alloy composition of claim 1 wherein the driveline component is a shaft.

5. The alloy composition of claim 1 having no more than about 0.035% phosphorous (P).

6. The alloy composition of claim 1 having no more than about 0.025% sulfur (S).

7. The alloy composition of claim 1 having no more than about 0.15% chromium (Cr).

8. The alloy composition of claim 1 having 0.04% of the silicon (Si).

9. The alloy composition of claim 1 wherein the carbonitrided case comprises an irregular case profile.

10. The alloy composition of claim 9 having a case depth within about 0.045 to 0.080 inches.

11. The alloy composition of claim 10 having an effective case hardness defined by 50 Rockwell C.

* * * * *